United States Patent [19]

Funae et al.

[11] Patent Number: 5,045,523

[45] Date of Patent: Sep. 3, 1991

[54] HEAT-SENSITIVE RECORDING MATERIALS

[75] Inventors: Haruyoshi Funae; Tomonori Kiriyama, both of Takasago, Japan

[73] Assignee: Mitsubishi Paper Mills Limited, Tokyo, Japan

[21] Appl. No.: 475,983

[22] Filed: Feb. 6, 1990

[30] Foreign Application Priority Data

Feb. 6, 1989 [JP] Japan ..... 1-028082
Feb. 23, 1989 [JP] Japan ..... 1-044766

[51] Int. Cl.[5] ..... B41M 5/40

[52] U.S. Cl. ..... 503/207; 503/200; 503/226; 428/323; 428/330; 428/331

[58] Field of Search ..... 503/200, 207, 226; 428/323, 330, 331

[56] References Cited

FOREIGN PATENT DOCUMENTS 5093 1/1984 Japan ..... 503/207

*Primary Examiner*—Pamela R. Schwartz

*Attorney, Agent, or Firm*—Cushman, Darby & Cushman

[57] ABSTRACT

A heat-sensitive recording material comprising a support, a heat-sensitive coloring layer provided thereon and optionally an undercoat layer provided between these two layers, said heat-sensitive coloring layer and/or said undercoat layer comprising specific, spherical, porous, inorganic particles. The heat-sensitive recording material is excellent in that a sufficient optical density can be obtained when printing is carried out with a low energy, and the fused matters do not substantially adhere to the thermal head when the recording material is printed and the optical density is hardly lowered when printing is carried out with a high energy.

15 Claims, No Drawings

HEAT-SENSITIVE RECORDING MATERIALS

BACKGROUND OF THE INVENTION

This invention relates to a heat-sensitive recording material. More particularly, this invention relates to an improved heat-sensitive recording material in which a color reaction of an electron donating, colorless or pale-colored dye precursor (hereinafter referred to as "coupler") with an electron accepting compound (hereinafter referred to as "developer") is utilized.

A heat-sensitive recording material containing a binary coloring agent consisting of a coupler and a developer has the advantage that it can be printed in one step and easily handled. Therefore, it is mainly used as the heat-sensitive recording material.

The heat-sensitive recording material is widely used in such fields as facsimiles, recording in measuring machines, labels and the like. Particularly in the facsimiles, the demand for the heat-sensitive material has remarkably increased and excellent properties are required as stated below.

Since a high speed facsimile was developed, it has been required that a sufficient optical density be obtained even when printing is carried out with electricity having a narrow pulse width, namely, with a low energy, and the heat-sensitive recording material be not colored with the heat remaining in the thermal head after the printing. Furthermore, molten matters have had to be prevented as much as possible from adhering to the thermal head.

In order to satisfy the above contradictory requirements, for example, Japanese Patent Application Kokai No. 54-23545 proposes a heat-sensitive recording material comprising inorganic powder having an oil absorption of at least 50 ml/100 g. Japanese Patent Application Kokai No. 59-225987 proposes a heat-sensitive recording material comprising a layer containing an expanded plastic filler.

However, in the case of these heat-sensitive recording materials, which can be colored with a low energy, there is a tendency that the amount of the molten matters adhered to the thermal head increases. Therefore, when printing is effected for a long period of time, the printed image becomes unclear or the printing sometimes becomes impossible on account of the molten matters adhering to the thermal head. Even if substantially no molten matters adhere to the thermal head, the optical optical density obtained is remarkably low because the molten matters soak under the heat-sensitive coloring layer when the printing is carried out with high energy.

SUMMARY OF THE INVENTION

It is an object of this invention to provide a heat-sensitive recording material consisting essentially of a support and a heat-sensitive coloring layer comprising a coupler and a developer as essential components, said recording material having high sensitivity and substantial no fused matters of the recording material adhering to a thermal head when the recording material is applied to a printer and the optical density of the recording material being hardly lowered when printing is carried out with a high energy.

In order to attain the above object, the present inventors have made extensive research. As a result, it has been found that the object of this invention that a sufficient optical density is obtained when printing is carried out with a low energy, and substantially no fused matters do not adhere to the thermal head and the optical density is hardly lowered when printing is carried out with a high energy can be attained by a heat-sensitive recording material comprising a support, a heat-sensitive coloring layer provided thereon and optionally an undercoat layer provided between these two layers, said heat-sensitive coloring layer and/or said undercoat layer comprising specific, spherical, porous, inorganic particles.

According to this invention, there is provided a heat-sensitive recording material consisting essentially of a support and a heat-sensitive coloring layer provided thereon, said heat-sensitive coloring layer comprising a coupler, a developer, a binder and spherical, porous, inorganic particles having a total pore volume of 0.4 ml/g or more and an average surface pore diameter of 0.005 μm or more (hereinafter referred to as "the first invention").

According to this invention, there is further provided a heat-sensitive recording material consisting essentially of a support, a heat-sensitive coloring layer comprising a coupler, a developer and a binder provided on the support and an undercoat layer provided between these two layers, said undercoat layer comprising a binder and spherical, porous, inorganic particles having a total pore volume of 0.4 ml/g or more and an average surface pore diameter of 0.005 μm or more (hereinafter referred to as "the second invention").

DETAILED DESCRIPTION OF THE INVENTION

In this invention, paper, synthetic paper, film or the like can be used as the support, and paper is preferred. As the paper, preferred is wood free paper.

In the first invention, the heat-sensitive coloring layer comprising the coupler, the developer, the binder and spherical, porous, inorganic particles may, if necessary, further comprise additives such as a wax, a sensitizer, a metal soap, an ultraviolet-ray absorbent, an oil-absorptive pigment and the like.

In the second invention, the heat-sensitive coloring layer comprising the coupler, the developer and the binder may, if necessary, further comprise the spherical, porous, inorganic particles and the additives mentioned above.

The spherical, porous, inorganic particles used in this invention have a total pore volume of 0.4 ml/g or more and an average surface pore diameter of 0.005 μm or more. In the first invention, the spherical, porous, inorganic particles preferably have an average particle diameter of 3 μm or less and a specific surface area of 200 $m^2/g$ or more. In the second invention, it is preferable that the spherical, porous inorganic particles have an average particle diameter of 3 μm or less and a specific surface area of 400 $m^2/g$ or more. In this invention, preferably, the spherical, porous, inorganic particles has a hollow structure.

The spherical, porous, inorganic particles can be obtained, for example, according to a precipitation reaction represented by the following formulas:

$$A+B \rightarrow C+D$$

An aqueous solution of the compound A is mixed with a water-insoluble organic solvent and the resulting mixture is emulsified to obtain a water-in-oil type emulsion.

The compound B is added to the resulting emulsion to cause the precipitation reaction on the surface of the particles of the aqueous solution of the compound A. The resulting precipitate is dried to obtain spherical porous inorganic particles. Specifically, there may be used the methods disclosed in Japanese Patent Application Kokai Nos. 63-229,140 and 63-258,642.

In order to allow the spherical, porous, inorganic particles to have a hollow structure, the following two methods may be used:

(1) To form large particles of the aqueous solution of the compound A when preparing the water-in-oil emulsion;

(2) To use an aqueous solution having a lower compound A content when preparing the water-in-oil emulsion;

In order to impart a higher porosity to the spherical, porous, inorganic particles, an acid-soluble component is added to the water-in-oil type emulsion and the compound B is added to the emulsion to cause the reaction of the compound A with the compound B, and then, the resulting precipitate is treated with an acid to elute the acid-soluble component.

The porous, inorganic particles obtained by the above methods are substantially spherical. The term "substantially spherical" used herein means that the eccentric ratio represented by the following formula is 0.9 or less when a photograph of the shape of the particle is taken using an electron microscope and the shape of the particle is regarded as an ellipse:

$$\frac{\sqrt{a^2 - b^2}}{a}$$

wherein a is the length of the long axis and b is the length of the short axis. The term "porous" used herein means that pores are present on the surface of and inside the spherical particle.

As an inorganic compound composing the spherical, porous, inorganic particles, there may be used an alkaline earth metal salt of carbonic acid such as calcium carbonate, barium carbonate or the like; an alkaline earth metal salt of silicic acid such as calcium cilicate, magnesium silicate or the like; a metal oxide such as silica (i.e. silicic acid anhydride), alumina, zirconia or the like; etc. In this invention, two or more kinds of the spherical, porous, inorganic particles may be used together. The spherical, porous, inorganic particles may be used together with other inorganic particles.

The first invention is described below.

The spherical, porous, inorganic particles are one of the essential components. The content thereof is not critical; however, the spherical, porous, inorganic particles are preferably contained in an amount of 5–60% by weight based on the weight of the heat-sensitive coloring layer.

The coupler contained in the heat-sensitive coloring layer may be any coupler used for a general pressure-sensitive or heat-sensitive material. Specifically, the coupler includes (1) triarylmethane type compounds such as 3,3-bis(p-dimethylaminophenyl)-6-dimethylaminophthalide (Crystal Violet Lactone), 3,3-bis(p-dimethylaminophenyl)phthalide, 3-(p- dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethyindol-3-yl)-6-dimethylaminophthalide, 3,3-bis(9-ethylcarbazole-3-yl)-5-dimethylaminophthalide, 3,3-bis(2-phenylindol-3-yl)-5-dimethylaminophthalide, 3-p-dimethylaminophenyl-3-(1-methylpyrrole-2-yl)-6-dimethylaminophthalide and the like; (2) diphenylmethane type compounds such as 4,4'-bis-dimethylaminophenylbenzhydrylbenzyl ether, N-halophenylleucoauramine, N-2,4,5-trichlorophenylleucoauramine and the like; (3) xanthene type compounds such as Rhodamine B anilinolactam, Rhodamine B p-nitroanilinolactam, Rhodamine B p-chloroanilinolactam, 3-diethylamino-7-dibenzylaminofluoran, 3-diethylamino-7-octylaminofluoran, 3-diethylamino-7-phenylfluoran, 3-diethylamino-7-chlorofluoran, 3-diethylamino-6-chloro-7-methylfluoran, 3-diethylamino-7-(3,4-dichloroanilino)fluoran, 3-diethylamino-7-(2-chloroanilino)fluoran, 3-diethylamino-6-methyl-7-anilinofluoran, 3-(N-ethyl-N-tolyl)amino-6-methyl-7-anilinofluoran, 3-piperidino-6-methyl-7-anilinofluoran, 3-(N-ethyl-N-tolyl) amino-6-methyl-7-phenethylfluoran, 3-diethylamino-7-(4-nitroanilinofluoran), 3-dibutylamino-6-methyl-7-anilinofluoran, 3-(N-methyl-N-propyl) amino-6-methyl-7-anilinofluoran, 3-(N-ethyl-N-isoamyl) amino-6-methyl-7-anilinofluoran, 3-(N-methyl-N-cyclohexyl) amino-6-methyl-7-anilinofluoran, 3-(N-ethyl-N-tetrahydrofuryl) amino-6-methyl-7-anilinofluoran and the like; (4) triazine type compounds such as benzoyl Leucomethylene Blue, p-nitrobenzoyl Leucomethylene Blue and the like; (5) spiro type compounds such as 3-methylspirodinaphthopyran, 3-ethylspirodinaphthopyran, 3,3'-dichlorospironaphthopyran, 3-benzylspirodinaphthopyran, 3-methylnaphtho-(3-methoxybenzo) spiropyran, 3-propylspirobenzopyran and the like; (6) mixtures of the above compounds. From these couplers, a suitable coupler is selected depending upon the use and desired properties.

As the developer contained in the heat-sensitive coloring layer, preferably used are phenol derivatives and aromatic carboxylic acid derivatives; more preferably used are bisphenols. Specifically, the phenol derivatives include p-octyl phenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3,5-dichlorophenyl)propane and the like. The aromatic carboxyalic acid derivatives include p-hydroxybenzoic acid, ethyl p-hydroxybenzoate, butyl p-hydroxybenzoate, 3,5-di-tert-butylsalicylic acid, 3,5-bis(o-methylbenzyl)salicylic acid, polyvalent metal salts of the carboxylic acids mentioned above, and the like.

The wax which may be used as one of the additives includes paraffin wax, carnauba wax, microcrystalline wax, polyethylene wax, higher fatty acid amides (e.g. stearamide, ethylenebisstearamide), esters of higher fatty acids and the like.

The metal soap which is one of the additives includes polyvalent metal salts of higher fatty acids such as zinc stearate, aluminum stearate, calcium stearate, zinc oleate and the like.

As the sensitizer which is one of the additives, there may be used a compound which has a sharp melting point at 80°–140° C., hence has a good heat-respondence. Specifically, the sensitizer includes esters of acids such as benzoic acid, terephthalic acid, naphthalenesulfonic acid and the like; naphthyl ether derivatives, anthryl ether derivatives, aliphatic ethers, phenanthrene, fluorene and the like. The waxes mentioned above can also be used as the sensitizer.

The oil-absorptive pigment preferably has an oil absorption of 50 ml/100 g or more in order to prevent the fused matters from adhering to the thermal head. The oil absorption is measured according to JIS K 5101. Specifically, the oil-absorptive pigment includes activated clays obtained by treating a raw earth containing montmorillonite, bentonite, kaolin or the like with an acid; various calcined kaolins obtained by calcining a raw ore containing kaolin; silicon oxides containing $SiO_2$ in an amount of 80% by weight or more, aluminum oxides containing $Al_2O_3$ in an amount of 80% by weight or more; and the like.

The above reagents are dispersed in a medium such as water with a binder. The support is coated with the resulting dispersion to form the heat-sensitive coloring layer.

The binder contained in the heat-sensitive layer is preferably water-soluble. Specifically, the binder includes poly(vinyl alcohol), hydroxyethylcellulose, hydroxypropylcellulose, ethylene/maleic anhydride copolymer, styrene/maleic anhdyride copolymer, isobutylene/maleic anhydride copolymer, poly(acrylic acid), starch derivatives, casein, gelatin and the like. In order to impart water resistance to the above binders, a water-resistance-improving agent (e.g. a gelling agent, a crosslinking agent), an emulsion of a hydrophobic polymer (e.g. styrene-butadiene rubber latex, acrylic resin emulsion) or the like may be added thereto.

The amount of the heat-sensitive coloring layer formed on the support is not critical; however, the heat-sensitive coloring layer is formed in a proportion of, preferably 3–15 g/m$^2$, more preferably 4–10 g/m$^2$ in terms of dry weight.

The heat-sensitive coloring layer may be provided directly on the support; however, one or more undercoat layers are preferably provided between the support and the heat-sensitive coloring layer in order to improve the sensitivity and prevent the fused matters from adhering to the thermal head. The undercoat layer comprises a pigment and a binder as essential components.

As the pigment contained in the undercoat layer, preferably used are the spherical, porous, inorganic particles mentioned above; however, there may also be used calcined kaolin, kaolin, natural silica, synthetic silica, aluminum hydroxide, calcium carbonate, calcium oxide, magnesium carbonate, magnesium oxide, a urea-formaldehyde filler, a cellulose filler and the like.

As the binder contained in the undercoat layer, there may be used a styrene-butadiene rubber latex, an acrylic resin emulsion, poly(vinyl alcohol), carboxymethylcellulose, hydroxyethylcellulose, styrenemaleic anhydride copolymer, starch and its derivatives, casein, gelatin and the like.

These reagents are dispersed in a medium such as water to prepare a coating composition for the undercoat layer. The coating composition may further contain reagent used for general coat paper such as a dispersing agent, an anti-foaming agent, a lubricant and the like.

The support is directly coated with the above coating composition to form the undercoat layer.

In order to form the heat-sensitive coloring layer and the undercoat layer on the support, a coating machine such as a blade coater, an air-knife coater, a roll coater, a rod coater, a curtain coater or the like may be used.

Furthermore, in order to improve the surface smoothness of the heat-sensitive recording material obtained, a suitable device such as a machine calender, a super calender, a gross calender, a brushing machine or the like may be used.

Incidentally, in order to improve the solvent resistance and the like, a protective layer may be provided on the heat-sensitive coloring layer.

The second invention is described below.

In the second invention, it is an essential requirement to provide an undercoat layer between the support and the heat-sensitive coloring layer. The undercoat layer comprises the spherical, porous, inorganic particles, as a pigment and a binder.

The heat-sensitive coloring layer may or may not contain the spherical, porous, inorganic particles. As the coupler, the developer, the binder and the additives contained in the heat-sensitive coloring layer, those mentioned in the first invention can be used.

The content of the spherical, porous, inorganic particles in the undercoat layer is not critical; however, the spherical, porous, inorganic particles are contained in an amount of, preferably 3–80% by weight, more preferably 5–50% by weight, based on the weight of the undercoat layer. The undercoat layer may further contain a pigment as mentioned in the first invention as to the undercoat layer.

As the binder contained in the undercoat layer, there are used those mentioned in the first invention as to the undercoat layer. The reagents which can be used in the coating composition for the undercoat layer in the first invention can also be used in the coating composition for the undercoat layer in the second invention.

The heat-sensitive coloring layer and the undercoat layer can be formed in the same way as in the first invention.

The present heat-sensitive recording material comprising the spherical, porous, inorganic particles in the heat-sensitive coloring layer and/or the undercoat layer is excellent in that a sufficient optical density can be obtained when printing is carried out with a low energy, and the fused matters do not substantially adhere to the thermal head when the recording material is subjected to printing and the optical density is hardly lowered when printing is carried out with a high energy.

Mechanisms to give the above-mentioned effects are supposed as follows:

(1) Because of the heat insulation property of the spherical, porous, inorganic particles, the heat energy possessed by the thermal head can be used efficiently. Therefore, the coloring sensitivity is improved. (2) Because of the spherisity of the porous, inorganic particles, the surface smoothness of the heat-sensitive recording material comprising the particles is improved. Thus, the heat energy can be uniformly conducted to the heat-sensitive layer from the thermal head. Accordingly, a uniform printed image can be obtained. This effect is conspicuous when the spherical, porous, inorganic particles have an average diameter of 3 μm or less. (3) Because of the porosity of the spherical, porous, inorganic particles, they swiftly absorb the molten matters in the heat-sensitive coloring layer, and hence, prevent the fused matters from adhering to the thermal head. Moreover, they prevent the fused matters from soaking under the heat-sensitive coloring layer. Therefore, the optical density is hardly lowered.

DESCRIPTION OF PREFERRED EMBODIMENT OF THE INVENTION

The following Examples further illustrate the invention. However, this invention is not restricted to these Examples.

The terms "parts" and "%" used herein represent "parts by weight" and "% by weight" respectively A total pore volume was measured by mercury forcing method using Mercury Pressure Porosimeter MOD 220 (manufactured by Carlo Erba). An average surface pore diameter and an average diameter of the inorganic particles were measured by the observation using an electron microscope. A specific surface area was measured by nitrogen gas adsorption method using Accursorb 2100E (manufactured by Shimadzu Seisakusho, Ltd.).

Example 1

(1) Preparation of undercoated paper

90 Parts of calcined kaolin (manufactured by Georgia Kaolin, Astrapaque), and 10 parts of spherical, porous silica (manufactured by Suzuki Yushi Kogyo K.K., E-2C) were dipersed in an aqueous solution of sodium hexametaphosphate to obtain a slurry containing 45% of the inorganic particles. 15 Parts of a 20% aqueous solution of starch esterified with phosphoric acid (manufactured by Nihon Shokuhin Kakou K.K., MS4600) and 15 parts of styrene-butadiene rubber latex (manufactured by Japan Synthetic Rubber Co., Ltd., JSR0692) were added thereto and stirred well. With the resulting mixture, wood free paper having a basis weight of 50 g/m$^2$ was coated so that the coated layer has a proportion of 8 g/m$^2$ in terms of dry weight. The paper coated above was dried to obtain undercoated paper.

(2) Preparation of a heat-sensitive recording material

As the coupler, 5 g of 3-N,N-diethylamino-6-methyl-7-(7-phenylamino)fluoran was added to 25 g of a 5% aqueous solution of poly(vinyl alcohol) (manufactured by Kuraray Co. Ltd. PVA-105). The resulting mixture was shaken in a ball mill for 24 hours to obtain a dispersion containing the coupler.

As the developer, 10 g of bisphenol A and, as the sensitizer, 10 g of stearamide were added to 100 g of a 5% aqueous solution of poly(vinyl alcohol). The resulting mixture was shaken in a ball mill for 24 hours to obtain a dispersion containing the developer and sensitizer.

As the pigment, 10 g of spherical, porous silica (E-2C) was added to 40 g of a 0.5% aqueous solution of sodium hexametaphosphate and dispersed in a homogenizer to obtain a dispersion containing the pigment.

These dispersions containing the coupler, the developer and sensitizer, and the pigment were mixed together. 5 g of a 30% aqueous solution of zinc stearate was added thereto to obtain a coating composition for the heat-sensitive layer. With the above coating composition, the undercoated paper obtained (1) above was coated and then dried so that the heat-sensitive coloring layer has a proportion of 5 g/m$^2$ in terms of dry weight. The dried paper was subjected to a super calendering treatment so that the paper has a Bekk smoothness of 300–500 sec to obtain a heat-sensitive recording material.

(3) Evaluation of heat-sensitive recording material

The heat-sensitive recording material obtained (2) above was uniformly printed by a heat-sensitive printing tester (manufactured by Okura Denki K.K., THPMD) under the condition that the printing speed was 18 msec/ line and the pulse width was 0.8 or 1.0 msec.

The optical density of the printed portion was measured by a reflection densitometer (manufactured by Macbeth).

The molten matters adhering to the thermal head after the printing (hereinafter referred to "thermal head stains") were observed and classified as follows:

○: The thermal head stains were not substantially observed.

Δ: The thermal head stains were a little observed.

Δ: The thermal head stains were remarkably observed.

X: The thermal head stains were quite remarkably observed.

EXAMPLE 2

The same procedure as in Example 1 was repeated except that the spherical, porous silica (E-2C) contained in the undercoat layer of Example 1 was not used and the amount of Astrapaque was increased to 100 parts.

EXAMPLE 3

The same procedure as in Example 2 was repeated except that spherical, porous, hollow silica (manufactured by Suzuki Yushi K.K., B-6C) was used as the pigment contained in the heat-sensitive coloring layer instead of the spherical, porous silica (E-2C) used in Example 2.

EXAMPLE 4

The same procedure as in Example 1 was repeated except that the undercoat layer was not provided.

EXAMPLE 5

The same procedure as in Example 2 was repeated except that spherical, porous calcium carbonate having a specific surface area of 150 m$^2$/g (hereinafter referred to as "calcium carbonate A") was used as the pigment contained in the heat-sensitive coloring layer instead of the spherical, porous silica (E-2C) used in Example 2.

COMPARATIVE EXAMPLES 1 and 2

The same procedure as in Example 3 was repeated except that light calcium carbonate (manufactured by Shiraishi Kogyo K.K., Brt-15) or calcined kaolin (manufactured by Engelhard, Ansilex) was used as the pigment contained in the heat-sensitive coloring layer instead of the spherical, porous hollow silica (B-6C) used in Example 3.

COMPARATIVE EXAMPLE 3

The same procedure as in Example 4 was repeated except that light calcium carbonate (Brt-15) was used as the pigment contained in the heat-sensitive coloring layer instead of the spherical, porous silica (E-2C) used in Example 4.

The amount of the pigment contained in the heat-sensitive recording materials obtained above and the results of the evaluation are shown in Table 1.

TABLE 1

| | | Pigment contained in the heat-sensitive coloring layer | | | | |
|---|---|---|---|---|---|---|
| | | ≧.4 Total pore volume, ml/g | ≧.005 Average surface pore diameter, μm | Average diameter of the particles, μm | Specific surface area, $m^2/g$ | Note |
| Example 1 | E-2C | 1.34 | 0.008 | 0.7 | 620 | — |
| Example 2 | E-2C | 1.34 | 0.008 | 0.7 | 620 | — |
| Example 3 | B-6C | 1.30 | 0.008 | 2.2 | 540 | hollow |
| Example 4 | E-2C | 1.34 | 0.008 | 0.7 | 620 | — |
| Example 5 | Calcium carbonate A | 0.60 | 0.005 | 2.2 | 150 | — |
| Comparative Example 1 | Brt-15 | 0.00 | 0.000 | 0.15 | 11.5 | — |
| Comparative Example 2 | Ansilex | 0.80 | 0.050 | 0.8 | 16.0 | amorphous |
| Comparative Example 3 | Brt-15 | 0.00 | 0.000 | 0.15 | 11.5 | — |

| | Pigment contained in the undercoat layer | | Optical density | | Thermal head |
|---|---|---|---|---|---|
| | Calcined kaolin | Spherical porous inorganic particles | At 0.8 msec | At 1.0 msec | stains |
| Example 1 | Astrapaque, 90 parts | E-2C, 10 parts | 1.15 | 1.30 | ○ |
| Example 2 | Astrapaque, 100 parts | — | 1.07 | 1.28 | Δ |
| Example 3 | Astrapaque, 100 parts | — | 1.10 | 1.31 | ○ |
| Example 4 | No undercoat layer is provided. | | 1.02 | 1.20 | Δ |
| Example 5 | Astrapaque, 100 parts | — | 1.03 | 1.23 | Δ |
| Comparative Example 1 | Astrapaque, 100 parts | — | 1.06 | 1.23 | Δ |
| Comparative Example 2 | Astrapaque, 100 parts | — | 1.02 | 1.22 | Δ |
| Comparative Example 3 | No undercoat layer is provided. | | 0.88 | 1.16 | X |

EXAMPLE 6

The same procedure as in Example 1 was repeated except that 25 g of the light calcium carbonate (Brt-15) was used as the pigment contained in the heat-sensitive coloring layer instead of the spherical, porous silica (E-2C) used in Example 1.

EXAMPLE 7

The same procedure as in Example 6 was repeated except that the amounts of Astrapaque and the spherical, porous silica (E-2C) were 60 parts and 40 parts respectively.

EXAMPLE 8

The same procedure as in Example 7 was repeated except that the spherical, porous calcium carbonate having a specific surface area of 300 $m^2/g$ (hereinafter referred to as "calcium carbonate B") was used as the pigment contained in the undercoat layer instead of the spherical, porous silica (E-2C) used in Example 7.

EXAMPLE 9

The same procedure as in Example 7 was repeated except that the spherical, porous, hollow silica (B-6C) was used as the pigment contained in the undercoat layer instead of the spherical, porous silica (E-2C) used in Example 7.

COMPARATIVE EXAMPLE 4

The same procedure as in Example 6 was repeated except that the spherical, porous silica (E-2C) contained in the undercoat layer of Example 6 was not used and the amount of Astrapaque was increased to 100 parts.

COMPARATIVE EXAMPLE 5

The same procedure as in Example 7 was repeated except that spherical, hollow particles composed of borosilicate glass (manufactured by Nihon Silica Kogyo K.K., K-330) were used as the pigment contained in the undercoat layer instead of the spherical, porous silica (E-2C) used in Example 7.

The amount of the pigment contained in the undercoat layer of the heat-sensitive recording materials obtained above and the results of the evaluation are shown in Table 2.

TABLE 2

| | Pigment contained in the undercoat layer | | | | |
|---|---|---|---|---|---|
| | | Spherical inorganic particles | | | |
| | Calcined kaolin | | Total pore volume, ml/g | Average surface pore diameter, μm | Average diameter of the particles, μm |
| Example 6 | Astrapaque, | E-2C, | 1.34 | 0.008 | 0.7 |

TABLE 2-continued

| | | | | | |
|---|---|---|---|---|---|
| Example 7 | 90 parts Astrapaque, 60 parts | 10 parts E-2C, 40 parts | 1.34 | 0.008 | 0.7 |
| Example 8 | Astrapaque, 60 parts | Calcium carbonate B, 40 parts | 0.60 | 0.005 | 2.2 |
| Example 9 | Astrapaque, 60 parts | B-6C, 40 parts | 1.30 | 0.008 | 2.2 |
| Comparative Example 4 | Astrapaque, 100 parts | — | — | — | — |
| Comparative Example 5 | Astrapaque, 60 parts | K-330, 40 parts | 0.57 | about 0 | 15 |

| | Pigament contained in the undercoat layer Spherical inorganic particles | | Optical Density | | Thermal head stains |
|---|---|---|---|---|---|
| | Specific surface area, $m^2/g$ | Note | At 0.8 msec | At 1.0 msec | |
| Example 6 | 620 | — | 1.05 | 1.25 | ○ |
| Example 7 | 620 | — | 1.17 | 1.34 | ○ |
| Example 8 | 300 | — | 1.06 | 1.26 | Δ |
| Example 9 | 540 | hollow | 1.10 | 1.28 | ○ |
| Comparative Example 4 | — | — | 0.97 | 1.22 | Δ |
| Comparative Example 5 | 0.3 | hollow | 1.01 | 1.21 | Δ |

As is clear from Tables 1 and 2, the heat-sensitive recording materials of this invention are excellent in that sensitivity is high and the thermal head stains are hardly observed.

What is claimed is:

1. A heat-sensitive recording material consisting essentially of a support and a heat-sensitive coloring layer provided on the support, said heat-sensitive coloring layer comprising a coupler, a developer, a binder and spherical, porous, inorganic particles having a total pore volume of 0.4 ml/g or more, an average surface pore diameter of 0.005 μm or more, and an average diameter of 3 μm or less.

2. A heat-sensitive recording material according to claim 1, wherein the spherical, porous, inorganic particles have a specific surface area of 200 $m^2/g$ or more.

3. A heat-sensitive recording material according to claim 1 or 2, wherein at least one undercoat layer comprising a pigment and a binder as essential components is provided between the support and the heat-sensitive layer.

4. A heat-sensitive recording material according to claim 1 or 2, wherein the heat-sensitive coloring layer comprises the spherical, porous, inorganic particles in an amount of 5–60% by weight based on the weight of the heat-sensitive coloring layer.

5. A heat-sensitive recording material consisting essentially of a support, a heat-sensitive coloring layer comprising a coupler, a developer and a binder provided on the support and an undercoat layer provided between these two layers, said undercoat layer comprising a binder and spherical, porous, inorganic particles having a total pore volume of 0.4 ml/g or more, an average surface pore diameter of 0.005 μm or more, and an average diameter of 3 μm or less.

6. A heat-sensitive recording material according to claim 5, wherein the spherical, porous, inorganic particles have a specific surface area of 400 $m^2/g$ or more.

7. A heat-sensitive recording material according to claim 5 or 6, wherein the undercoat layer comprises the spherical, porous, inorganic particles in an amount of 3–80% by weight based on the weight of the heat-sensitive coloring layer.

8. A heat-sensitive recording material according to claim 5 or 6, wherein the undercoat layer comprises the spherical, porous, inorganic particles in an amount of 5–50% by weight based on the weight of the heat-sensitive coloring layer.

9. A heat-sensitive recording material according to claim 1, 5, 2 or 6, wherein the spherical, porous, inorganic particles have a hollow structure.

10. A heat-sensitive recording material according to claim 1, 5, 2 or 9, wherein the spherical, porous, inorganic particles consist essentially of an alkaline earth metal salt of carbonic acid, an alkaline earth metal salt of silicic acid or a metal oxide.

11. A heat-sensitive recording material according to claim 10, wherein the alkaline earth metal salt of carbonic acid is calcium carbonate or barium carbonate.

12. A heat-sensitive recording material according to claim 10, wherein the alkaline earth metal salt of carbonic acid is calcium carbonate.

13. A heat-sensitive recording material according to claim 10, wherein the alkaline earth metal salt of silicic acid is calcium silicate or magnesium silicate.

14. A heat-sensitive recording material according to claim 10, wherein the metal oxide is silica, alumina or zirconia.

15. A heat-sensitive recording material according to claim 10, wherein the metal oxide is silica.

* * * * *